US006796103B2

(12) United States Patent
Gamberini

(10) Patent No.: US 6,796,103 B2
(45) Date of Patent: Sep. 28, 2004

(54) MACHINE FOR PACKAGING STACKS OF MULTIPLY PAPER ARTICLES OR THE LIKE INTO WRAPPINGS OBTAINED FROM A WRAPPING SHEET

(76) Inventor: Gianluigi Gamberini, Via Carrati 12, Bologna (IT)

( * ) Notice: Subject to any disclaimer, the term of this patent is extended or adjusted under 35 U.S.C. 154(b) by 0 days.

(21) Appl. No.: 10/023,563

(22) Filed: Dec. 18, 2001

(65) Prior Publication Data

US 2002/0073649 A1 Jun. 20, 2002

(30) Foreign Application Priority Data

Dec. 20, 2000 (IT) ..... B02000A0733

(51) Int. Cl.[7] ..... B65B 49/00

(52) U.S. Cl. ..... 53/228; 53/232; 53/389.1; 53/389.5

(58) Field of Search ..... 53/230, 232, 228, 53/586, 574, 389.1, 389.2, 389.3, 389.4, 389.5; 271/272, 276, 196

(56) References Cited

U.S. PATENT DOCUMENTS

| | | | | | |
|---|---|---|---|---|---|
| 2,107,482 A | * | 2/1938 | Kemp | 53/230 |
| 3,277,630 A | * | 10/1966 | Youngman et al. | 53/389.3 |
| 3,996,728 A | | 12/1976 | Gentili et al. | |
| 4,073,487 A | * | 2/1978 | Schirrmeister et al. | 271/279 |
| 4,251,067 A | * | 2/1981 | Mitzel | 271/196 |
| 4,261,559 A | * | 4/1981 | Mitzel | 271/196 |
| 4,385,479 A | * | 5/1983 | Focke | 53/389.3 |
| 4,738,078 A | | 4/1988 | Benz et al. | |
| 4,924,653 A | * | 5/1990 | Oly | 53/66 |
| 5,103,703 A | * | 4/1992 | Littleton | 83/155 |
| 5,179,815 A | * | 1/1993 | Cahill et al. | 53/133.3 |

FOREIGN PATENT DOCUMENTS

| | | |
|---|---|---|
| BE | 664 859 A | 10/1965 |
| EP | 0 795 472 A1 | 9/1997 |
| WO | WO 97/41033 | 11/1997 |

* cited by examiner

*Primary Examiner*—John Sipos
*Assistant Examiner*—Louis Tran
(74) *Attorney, Agent, or Firm*—William J. Sapone; Coleman Sudol Sapone, P.C.

(57) ABSTRACT

In a machine for packaging stacks of multiply articles of paper into wrapping sheets, a first line conveys stacks of multiply articles of paper to a a wrapping station while a second feeds wrapping sheets to the wrapping station. Each sheet is kept vertically in a waiting position in the wrapping station until one stack is moved towards the sheet, so that the sheet gradually folds around the stack with overlapping parallel edges to be heat-welded. In the said second line there are first endless belts and second endless belts for a wrapping sheet received from conveying means situated upstream. The sheet is pulled up to the wrapping station and is clamped in the wait position by suction.

19 Claims, 9 Drawing Sheets

MACHINE FOR PACKAGING STACKS OF MULTIPLY PAPER ARTICLES OR THE LIKE INTO WRAPPINGS OBTAINED FROM A WRAPPING SHEET

TECHNICAL FIELD OF THE INVENTION

The present invention relates to packaging of stacks of multiply paper articles or the like, by wrapping each stack, or two or more stacks, with a heat-weldable wrapping sheet folded around the stack and welded along overlapped areas, so as to define a wrapping.

The articles can be of different type, e.g. folded handkerchiefs of elastic tissue, paper napkins, of one or more layers, smooth, creased, padded, etc.

DESCRIPTION OF THE PRIOR ART

Machines for packaging stacks of multiply paper articles or the like, by wrapping each stack, or two or more stacks, with a heat-weldable wrapping sheet folded around the stack and welded along overlapped areas, typically include:

- a first line for conveying stacks of articles
- a second line for feeding the wrapping sheets, which, in a working station, places and maintains each sheet, so that it is kept dwelling in vertical position;
- a third line arranged perpendicular to the first line, from which the third line is fed stepwise and crosswise to said working station, so that each stack gets engaged with a wrapping sheet, for packaging the stacks into a respective wrappings.

In the packaging line, the stack engages the sheet, which is pulled thereby and, in cooperation with suitable means, folded around the stack, so as to take a substantially sleeve-like shape with the edges overlapped and subsequently welded.

The heads of the sleeve are first folded onto the front and rear facings of the stack and then welded to define the stack wrapping.

The wrapping sheets are usually made of polypropylene, whose rigidity is comparable with paper rigidity, so positioning and forwarding sheets in horizontal or vertical position does not cause particular problems, taking into consideration the techniques currently used.

However, it is to be noted that the cost of polypropylene increases considerably the cost of the package.

From the economic point of view, polythene is advisable, though its flexibility causes big difficulties to its moving, obtained by mechanical means, and/or positioning; therefore the its current use is not significant.

In a known machine, the second line includes a reel, situated upstream the line, from which continuous film is drawn stepwise, to obtain wrapping sheets.

Each sheet is conveyed and kept in the working station by strip-like belts connected functionally to vacuum means.

The second line includes two endless conveyors, situated one over the other downstream of the working station, with their runs facing each other.

The vacuum means keep steady the sheet in said working station until it is hit by a stack and clamped between the said opposite runs of the endless conveyors, which allows deactivation of the vacuum means.

It is to be noted that anticipated deactivation of the vacuum means with respect to the clamping makes the sheet fall, while a late deactivation stretch the sheet, which is kept by the vacuum on one side, and pushed by the stack on the other.

Taking into consideration the elasticity and inertia of the used fluid, i.e. air, technical-functional complications are evident.

The above described technical solution does not allow rapid adaptation of the machine to any size change.

According to another known machine, strip-like belts are used to place the sheet in the working station.

The sheet is cut from the film when it is clamped between an already packaged stack, situated downstream of the working station, and a stack to be packaged, situated upstream.

The strip-like belts are disengaged from the edges of the sheet in time relation with what has been said above.

In both known machines, the film is delivered by the relative reel in a discontinuous way, which causes alternating acceleration and deceleration resulting in pulling and releasing of the film.

The film, with ornaments and/or information about the product to be packaged, is often shifted, which can result in undesired offsets of the writings with respect to the article.

This disadvantage can be limited by setting the reel at high level, i.e. as close as possible to the film cutting station, or by using suitable actuators, connected to sensors, which reset the predetermined position of the wrapping sheet.

The known machines are complicated and expensive, and their efficiency is limited due to the strict inter-relation between the film cutting and the sheet keeping action in the working station.

SUMMARY OF THE INVENTION

The object of the present invention is to avoid the above mentioned disadvantages by a machine, whose working station receives, locates and keeps each wrapping sheet in a rapid and efficient way, no matter of the stack size, of the material of the wrapping sheet and of the number, i.e. two or more, of stacks of articles being packaged arranged side by side.

Another object of the present invention is to propose a machine, in which the wrapping sheet is kept in the working station not only by vacuum means.

A further object of the present invention is to propose a machine which avoids curling or stretching of the wrapping sheet during its wrapping around the stack.

A still further object of the proposed machine is to give perfectly calibrated, although semi-rigid, packages.

A yet further object of the present invention is to propose a machine, in which operation speed of the stacks feeding line depends on the working means of the packaging line, cooperating with the working station, and in which the feeding line deactivates means for pulling the stacks, if these means are stressed in an anomalous way.

The above mentioned objects are obtained, in accordance with the contents of the claims, by a machine for packaging stacks of multiply articles of paper or the like, into wrappings obtained by wrapping sheets, the machine including:

- a first line for conveying and separating stacks of multiply articles of paper;
- a working station for wrapping stacks of multiply articles of paper;
- a second line for feeding stepwise heat-weldable wrapping sheets to the working station, each sheet being placed and kept vertically in a waiting position in the working station;
- a third line (3) including an upstream section fed stepwise with stacks by the first line, and passing crosswise through the working station, the third line moving at least one stack towards the sheet, so that the sheet gradually folds around the stack or stacks longitudinal contour while overlapping parallel edges of the sheet are heat-welded;

said second line further including:

first means and second means designed for receiving a wrapping sheet from conveying means situated upstream, for pulling said sheet to said working station, for clamping said sheet in said working station in at least one upper area;

keeping means cooperating with said first means to allow said sheet to pass through said working station and to be stabilized while dwelling therein.

BRIEF DESCRIPTION OF THE DRAWINGS

The characteristic features of the present invention will be pointed out in the following description of a preferred, but not unique embodiment, with reference to the enclosed drawings, in which.

DISCLOSURE OF THE PREFERRED EMBODIMENTS

Figure 1:
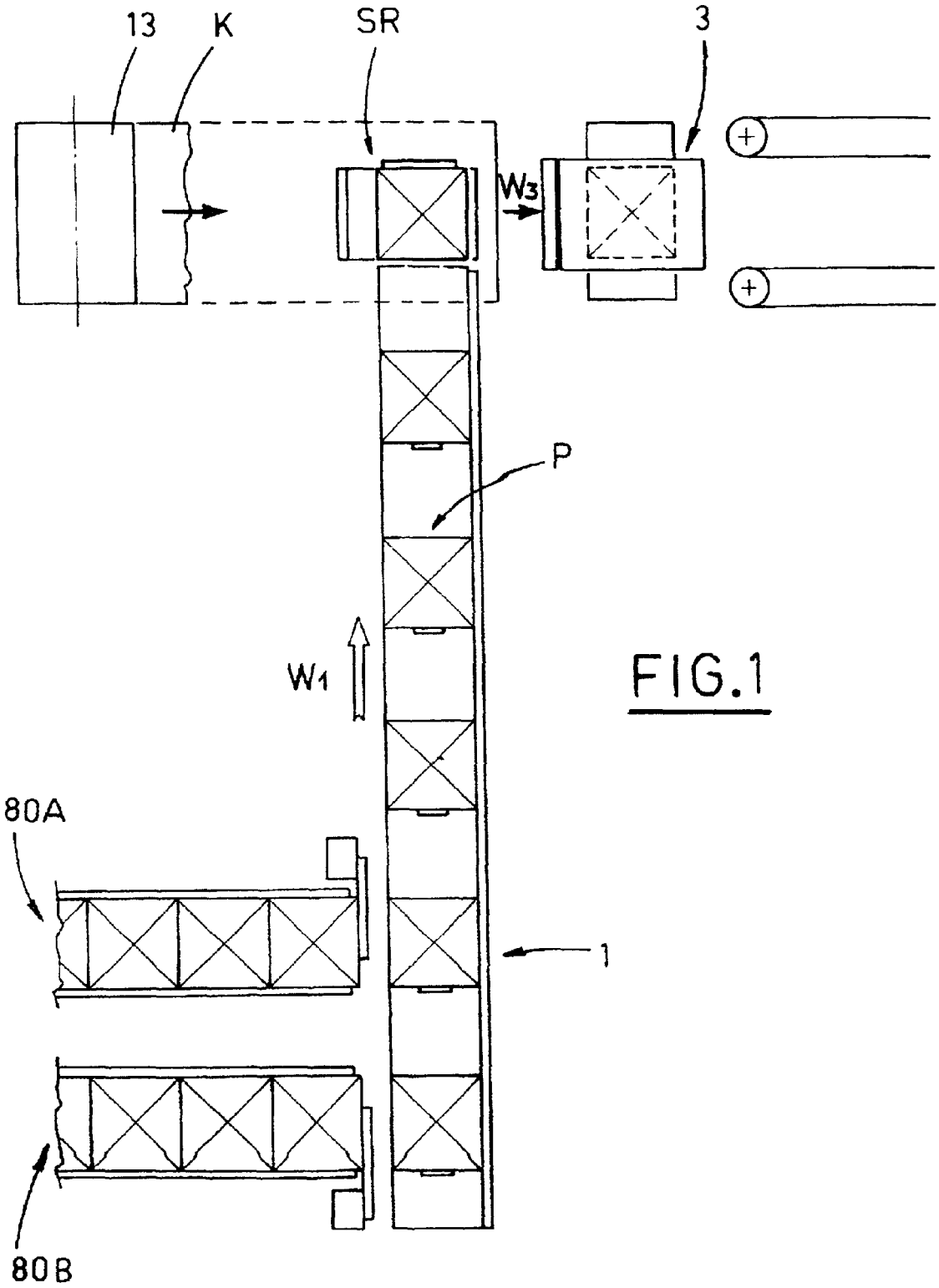
FIG. 1 is a schematic, partial, top view of the proposed machine.

FIGS. 1, 2 and 3*a*, 3*b* show as many lines, first, second and third, respectively for conveying, for separating (direction W1) of stacks P of articles, e.g. multiply articles of paper or the like, for feeding wrapping sheets F (direction W2) and finally, for packaging, in which the stacks are wrapped with sheets F, in direction W3.

The first line 1 ends at a receiving station SR of the third line 3, situated at the beginning thereof; the second line 2 defines, in its final part, a working station SO, situated in the third line 3, downstream of the previous station SR with respect to the direction W3 of the third line.

The first line 1 includes, in known way, a running plane 4 equipped with longitudinal seats (not shown) oriented in the direction W1.

Wings 5A of right angle, regularly spaced apart, pulling elements 5, run inside the above mentioned seats.

Figure 5:
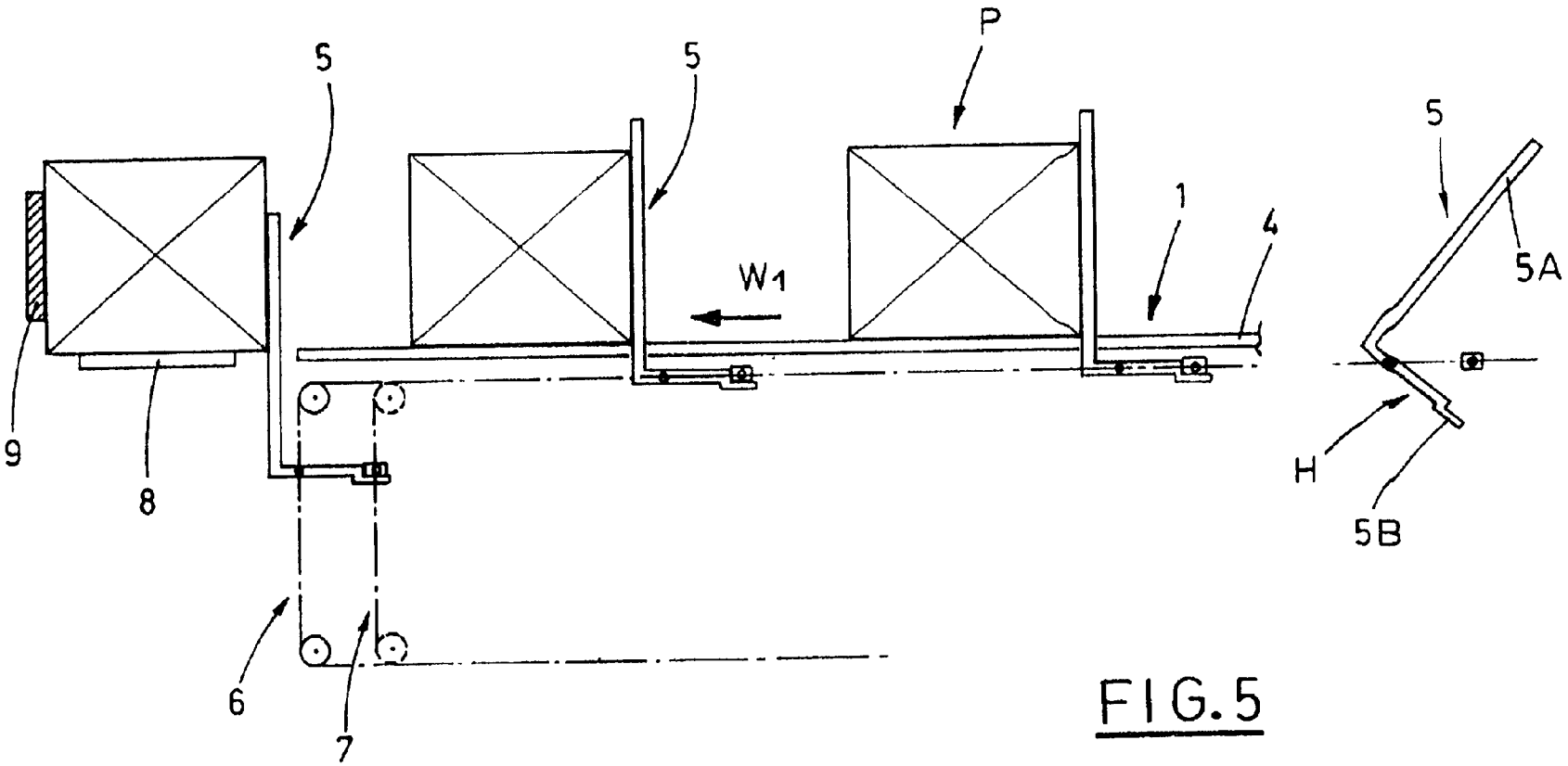
FIG. 5 is a schematic, partial, lateral view of the line feeding stacks of articles.

The base 5B of each pulling element 5 is hinged, in known way, to an outer ring 6, which extends vertically, and connected to an inner ring 7, likewise extending vertically, so as to maintain the wings 5A in vertical position in the region of the upper runs (which are coplanar), as well as at the ends of the runs, as shown in FIG. 5.

Consequently, the wing 5A maintains its perfect vertical position during the passage of the stack P from the plane 4 to a horizontal receiving base 8, against a vertical end stop 9, which are situated in the receiving station SR of the third line.

Then, the wing 5A gradually goes downwards.

It is to be pointed out that the connection of the base 5B with the inner ring 7 is removable, e.g. obtained by magnetic means.

This constitutes effective security, because, in case the wing 5A is subjected to anomalous stresses caused by e.g. messy piling up of the stacks P on the plane 4, or due to other factors, the base 5B is disconnected from the inner ring and the element 5 rotates on the hinge with the outer ring 6: see disconnection position H in FIG. 5.

The detection, in known way, of the above described position causes the stop of the first line 1 and of the whole machine.

The second line 2 includes a reel 13 (placed in a position considered the best by the constructor, e.g. low, near the base of the machine), from which a heat-weldable film K, e.g. polythene, is drawn continuously.

Figure 2:
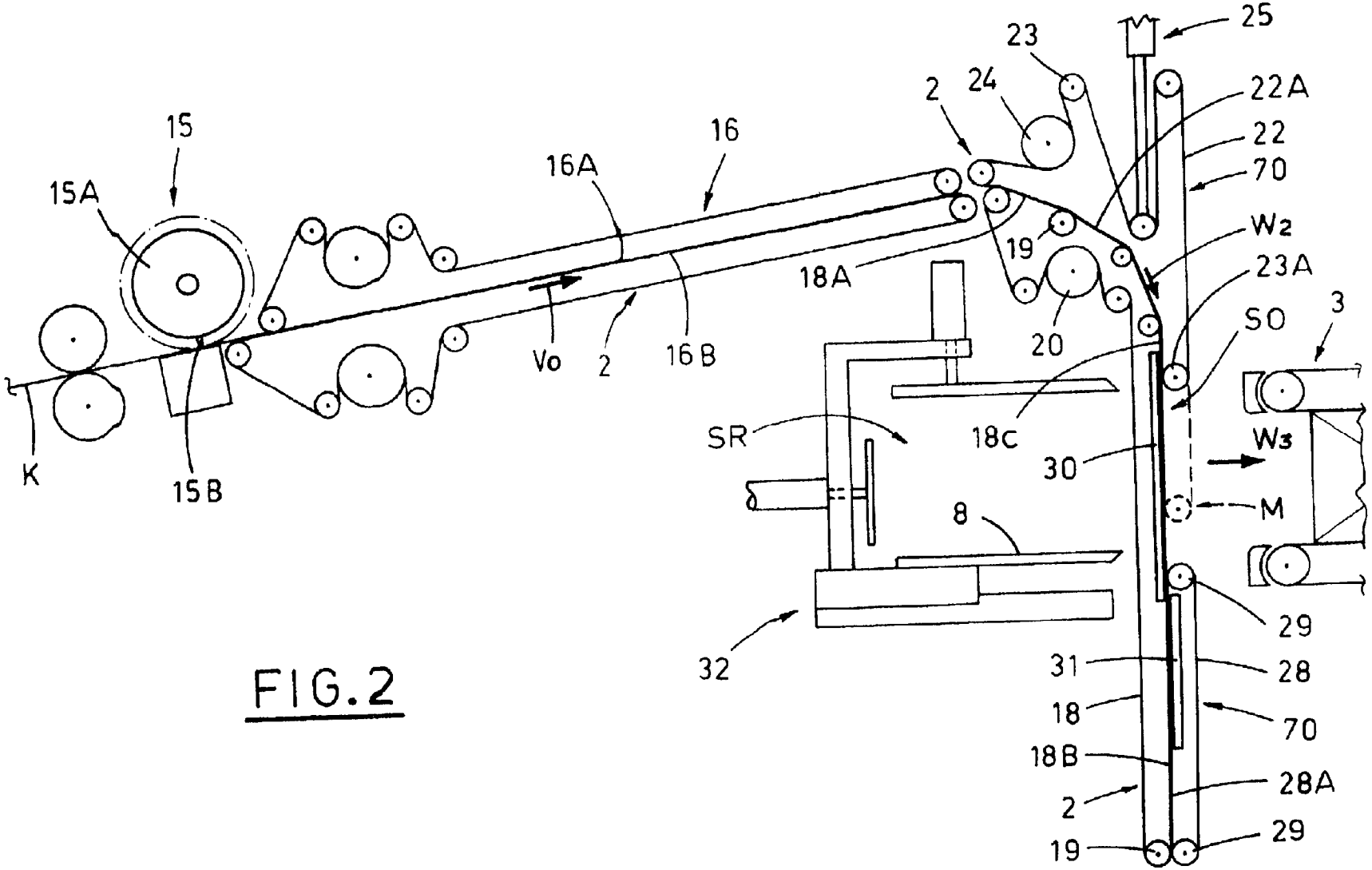
FIG. 2 is a schematic, partial, front view of the machine.

The film K passes through a so-called slow run 16, formed more precisely by the facing runs of three pairs of endless conveyors 16A, 16B, only one of which is shown in the FIG. 2.

The runs move with a constant speed $V_0$ in the direction W2.

A cutting group 15 (e.g. a rotating blade 15A cooperating with a stationary blade 15B), is situated downstream of the slow run and operates stepwise to make crosswise cutting lines (defining as many pre-breaking sections) spaced apart by a predetermined spacing depending on the stack size.

It is to be pointed out that the reciprocal facing position of the runs 16A, 16B, on one hand, allows the film K to be pulled, but on the other hand is such to allow sheet F, obtained by breaking the first pre-breaking section, can slide with respect to the same facing runs, as will be explained later on.

A working group 70, situated downstream of the slow run 16, grips the leading edge of the film K exiting the slow run, detaches the sheet F from the film K and pulls the detached sheet F until it is situated and kept in the above mentioned working station SO.

The working group 70 includes first means and second means, the latter defined by two sections, upper and lower, respectively.

The first means include a pair of first endless strip-like belts 18, only one of which is shown in the FIG. 2, mounted around idler wheels 19 and a driving wheel 20, so as to define a straight vertical section near the station SO and to face the edges of a surface of the sheet F.

The upper section of the second means includes a pair of second endless strip-like belts 22 (only one of which shown in the Figure), mounted around idler wheels 23 and a driving wheel 24 to and facing the edges of the other surface of the sheet F and to define a short straight vertical section near the station SO.

The mutual spatial arrangement of the first strip-like belts 18 and the second strip-like belts 22 defines two facing runs 18A, 22A, which on one side follow the runs 16A, 16B of the slow run and, on the other side lead to the station SO.

It is to be pointed out that, in order to change size, the height level of the lower idle wheel 23A can be adjusted vertically (see the position M indicated with broken line in FIG. 2), by acting on tensioning means 25: consequently the vertical straight section, along which the first strip-like belts 18 and the second strip-like belts 22 join, changes.

The lower part of the second means includes a pair of third endless strip-like belts 28 (only one of which is shown), mounted around at least two wheels 29, one of which being a driving wheel, so as to face the edges of the same surface of the sheet, on which the belts 22 of the upper part work.

Figure 9:
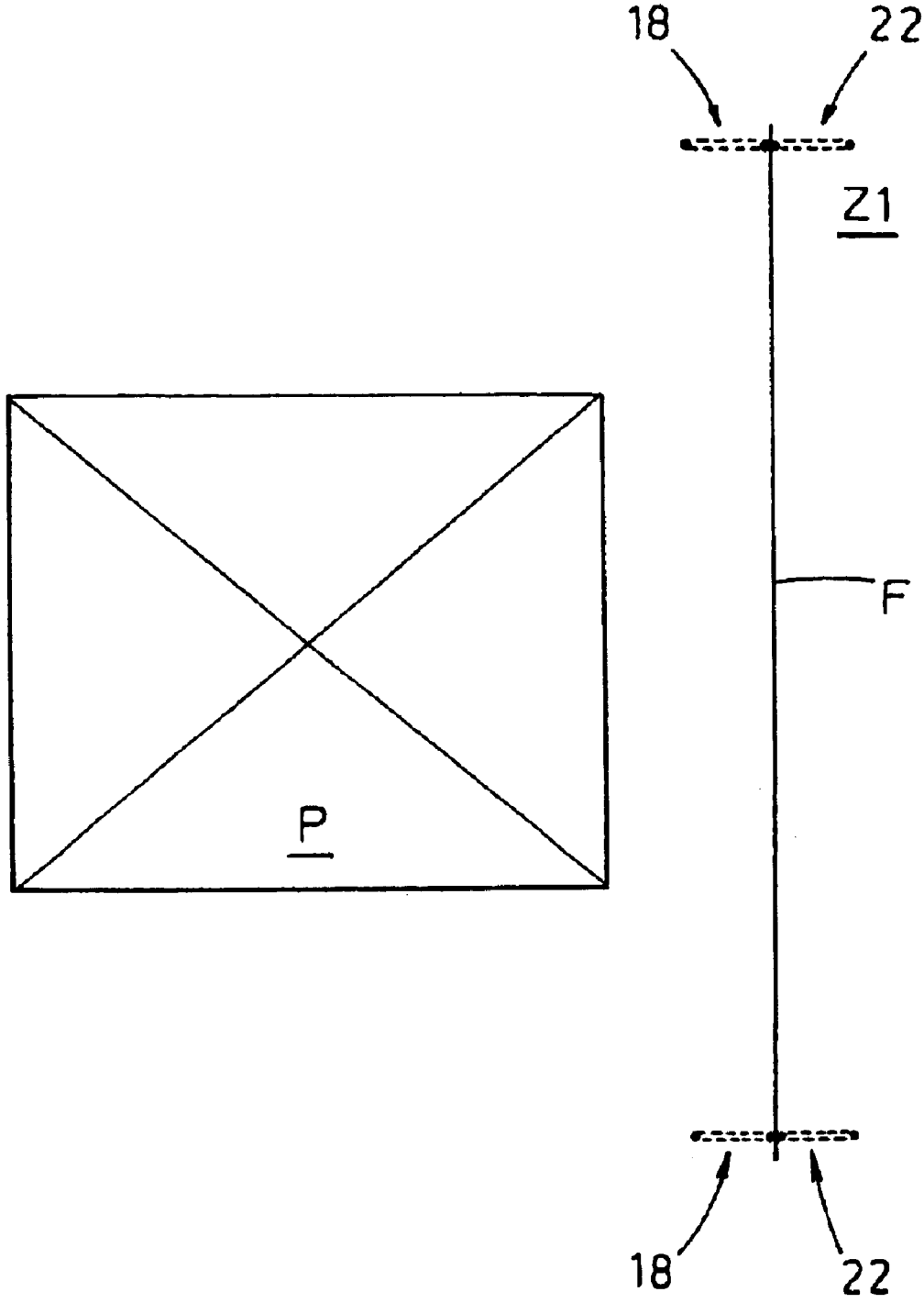
FIG. 9 is a schematic partial top view showing in detail an upper section of first means and second means of the line feeding wrapping sheets to a working station.

FIG. 9 shows how the endless belts 18 and 22 are disposed in mirror image on opposite sides of the sheet F, for gripping the sheet edges.

The pair of the third strip-like belts 28 can take two extreme configuration.

In the first configuration C1 (FIGS. 2, 3*a*, 3*b*) the inner runs 28A of the belts are in vertical position and face the vertical parts 18B of the first belts 18.

Figure 4A:
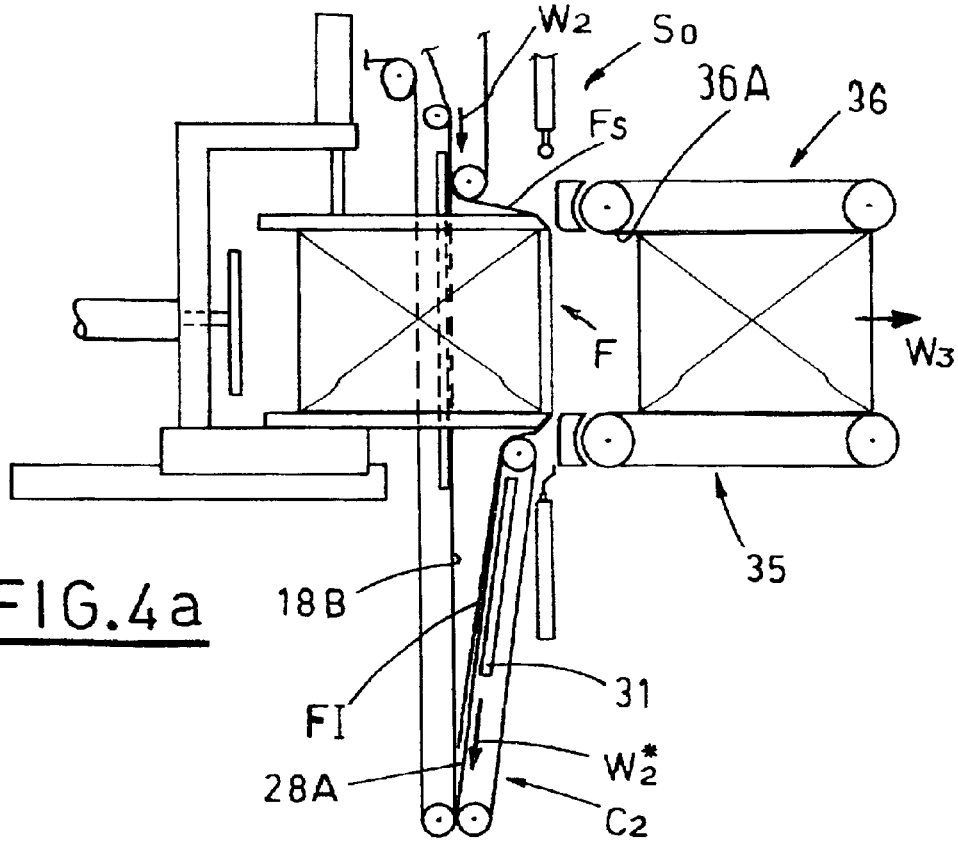
Figure 4B:
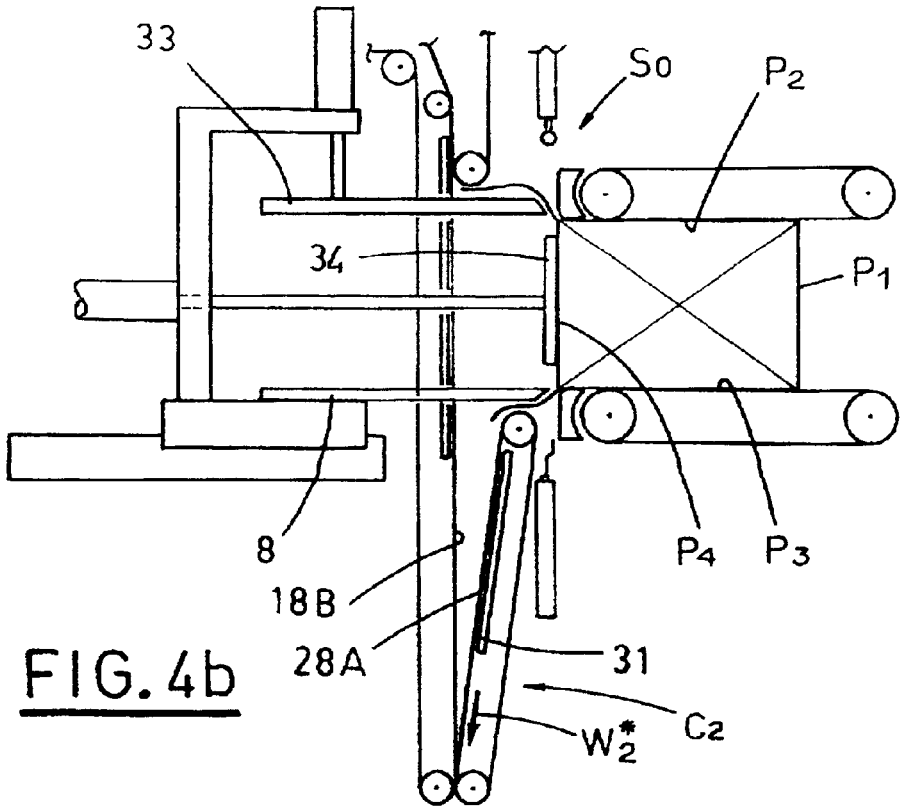

In the second configuration C2 (FIGS. 4*a*, 4*b*), the inner runs 28A are inclined rightwards and outwards (with reference to the above mentioned FIGS), and consequently, moved far from the facing parts 18B of the first belts 18.

It is to be pointed out that a window Y is created between the lower wheel 23A of the upper part and the upper wheel 29 of the lower part.

The height of the window Y changes in relation to the level imposed to the lower wheel 23A.

The inner runs 18C of the first belts 18 are connected, in the region of the window Y, with means 30, connectable to a vacuum source, not shown; advantageously, the first belts feature through holes communicating with these means.

The inner runs 28A of the third belts 28 of the lower part are connected with means 31, connectable to a vacuum source; also in this case, the belts feature through holes communicating with the means 31.

A slide 32, situated in the packaging line 3, upstream of the working station SO, more precisely, in the receiving station SR, moves longitudinally, following to-and-fro strokes, along the direction defined by the direction W3.

The lower part of such slide carries the base 8, whereas the upper part thereof carries a pressing plate 33, parallel to the base, and the side part of the slide supports a pusher 34, which is perpendicular to the base.

Two endless belt conveyors 35, 36, situated one above another, are situated in the packaging line 3, downstream of the working station SO. The upper run 35A of the lower conveyor 35 is coplanar with the base 8.

The conveyors 35, 36 face, with their side turned toward the working station SO, shaped profiles 37, 38, which will be told about later on, connected with known folding—welding means 39, 40, likewise described later on.

Now the operation of the proposed machine will be described.

A basic packaging cycle includes the transfer of a stack P, coming from the line 1, to the base 8, and the positioning of a sheet F in the working station SO, where the sheet is oriented vertically as well as crosswise to the direction W3 of the third packaging line 3.

The transfer of the stack has been already described; it is to be pointed out that the stack P must not protrude beyond the tapered ends 8A, 33A of the base 8 and the pressing plate 33, respectively.

Obtaining of the sheet F, its transfer to the station SO and keeping it therein, is accomplished in the following way.

Figure 7:
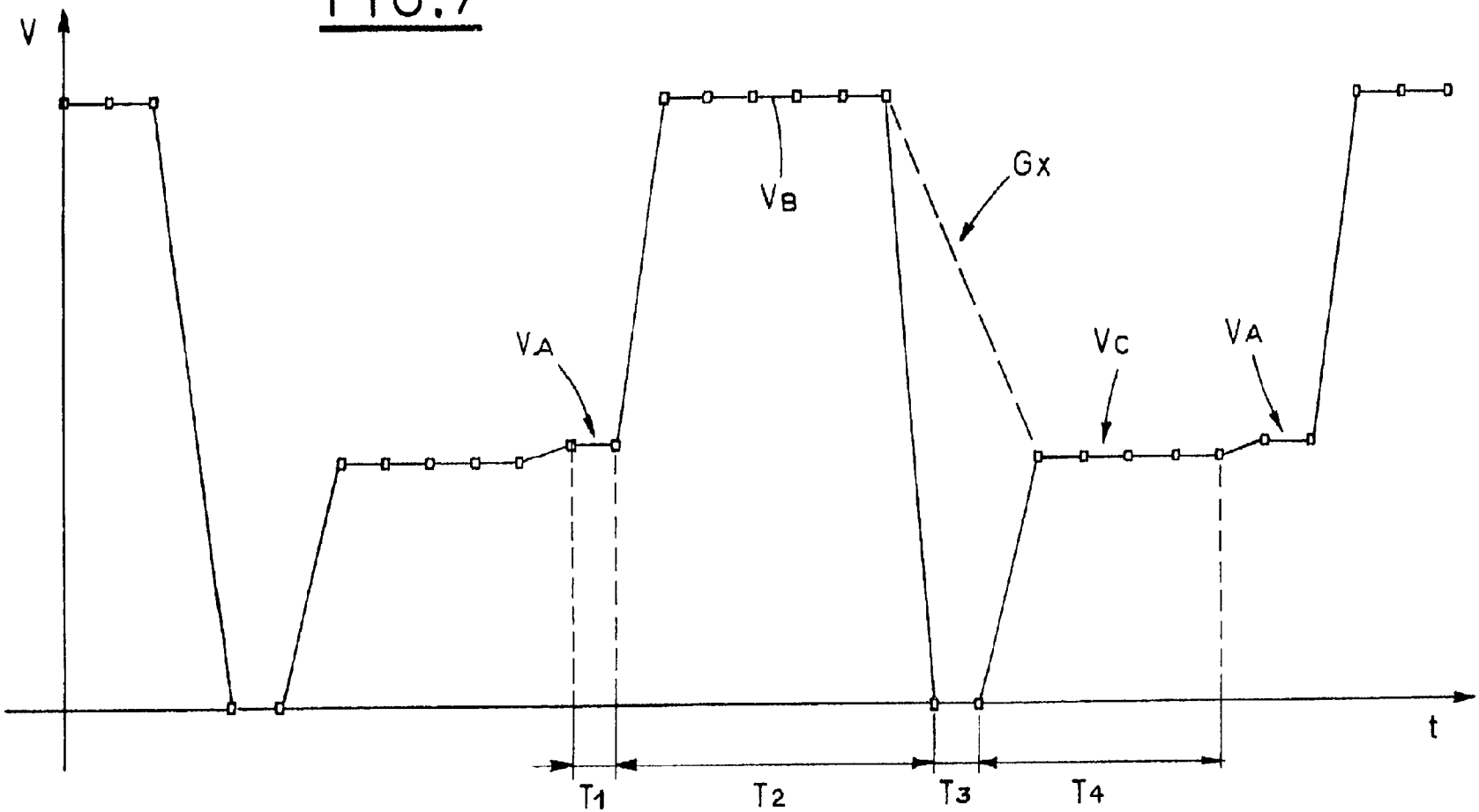
FIG. 7 is a graph showing the speed of means pulling the wrapping sheet as a function of time.

The first strip-like belts 18, the second strip-like belts 22 and the third strip-like belts 28 are operated at the same speed, whose variations in relation to the time are shown in FIG. 7.

In the interval T1, the speed VA is equal to the speed V0 of the slow run 16; in this interval, the leading edge of the film K enters the initial part of the runs 18A, 22A; the same speed facilitates and optimizes such introduction.

Afterwards, the speed of the belts reaches the maximum value VB, and maintains this value in the interval T2; the acceleration imposed to the film causes the separation of the sheet F from the film due to the breaking of the first pre-breaking section made by the cutting group 15.

The sheet F, not blocked by the slow run 16, is conveyed to the window Y and crosses it, because the sheet edges are in engagement with the inner run 18C due to the operation of the means 30.

When the interval T2 is finished, the speed is set to zero and the means 30 are deactivated: in this latter situation, which continues during the interval T3, the sheet F is stabilized in the vertical position, normal with respect to the direction W3, because it is clamped in two areas—upper Z1 (first and second belts 18, 22) and lower Z2 (first and third belts 18, 28).

Consequently, the stabilization of the sheet F in the working station SO is performed only by the belts clamping action.

Figure 3A:
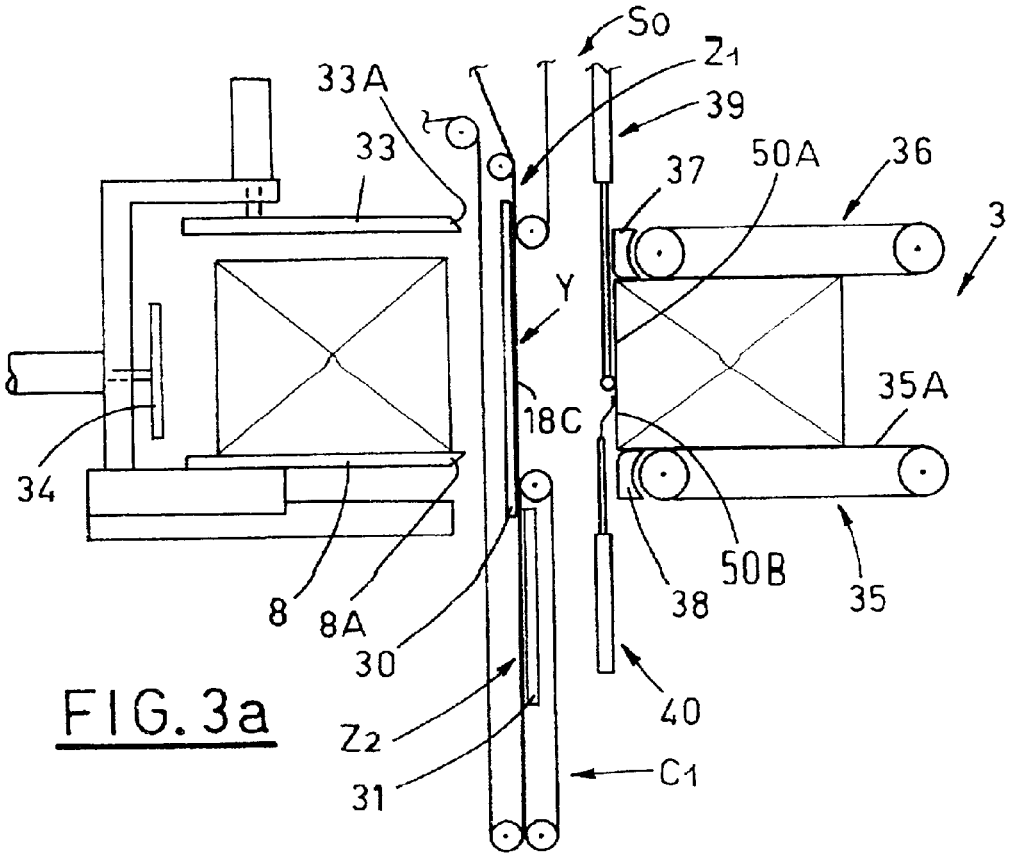
FIGS. 3*a*, 3*b*, 4*a*, 4*b* show calibration of a stack of articles and wrapping thereof with a wrapping sheet.
Figure 3B:
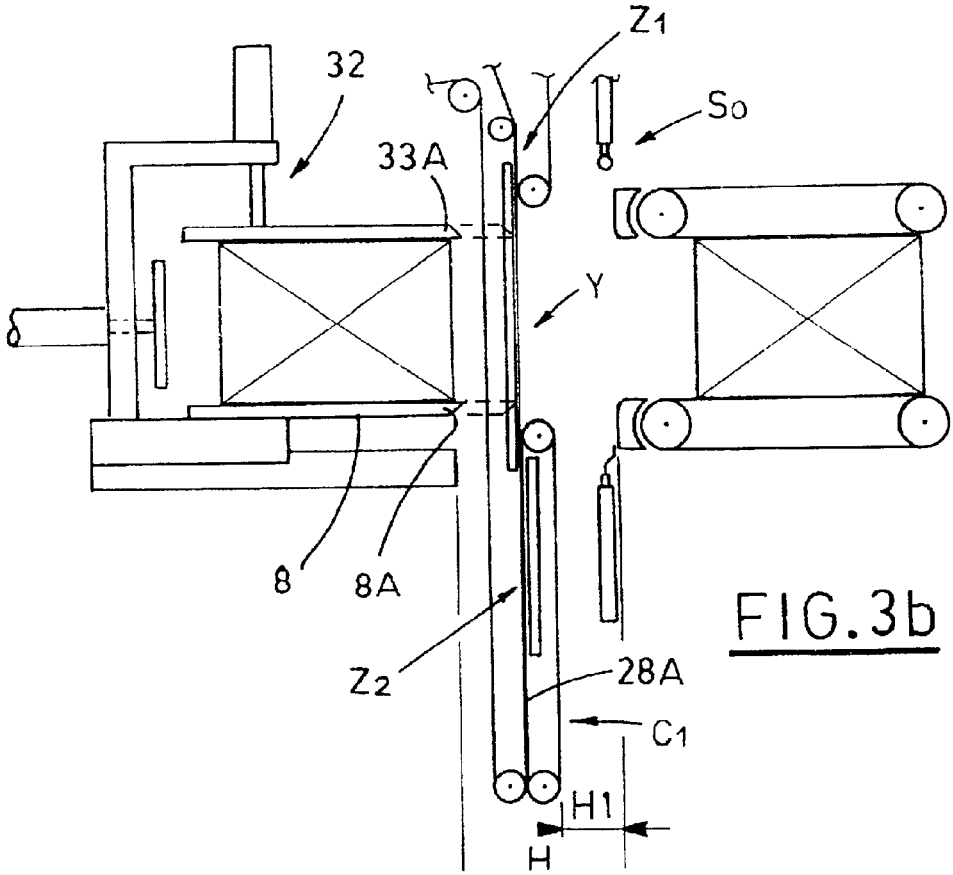

In time relation with what just said, the pressing plate 33 presses the stack P, coming to the level of the lower run 36A of the upper conveyor 36, and the slide 32 moves in the direction W3, thus bringing the ends 8A, 33A to hit the sheet F (FIG. 3*b*).

In time relation with such hit action, at least the first and second belts 18, 22 are operated at a speed VC, equal to the so-called "extrusion speed", and the inner runs 28A of the third belts move away from the first belts 18 and finally, the means 31 are activated.

In time relation with the slide stop, with the ends 8A, 33A near the shaped profiles 37, 38, the pusher 34 is operated to extrude the stack P compressed between the facing surfaces of the base 8 and the pressing plate 33, introducing it between the runs 35A, 36A of the conveyors 35, 36.

The speed VC, with which the belts 18, 22 feed the upper part $F_s$ of the sheet, is equal to the speed, with which the stack is extruded; the lower part $F_I$ is not blocked by the belts 28, which cooperate with the suction means 31 to perform a kind of adjustable friction, maintaining the lower part $F_I$ tight.

It is to be pointed out that the shaped profiles 37, 38 facilitate and guide the stack introduction between the runs 35A, 36A.

When the introduction of the pile between the latter runs has been completed, the slide 32 withdraws, the pusher 34 withdraws with respect to the slide and the pressing plate 33 goes up: the conditions of the FIG. 3*a* are restored.

The stack P, clamped between the runs 35A, 36A, is wrapped with the sheet F along three successive sides P1, P2, P3 of its longitudinal contour.

The means 39, 40 overlap the edges 50A, 50B of the sheet F on the fourth side P4 of the stack, and subsequently, heat-weld the edges according to techniques known to those skilled in the art; thus the conditions of FIG. 3*a* are restored.

When the upper part $F_s$ is withdrawn from the belts 18, 20, the latter are brought back to the speed VA: thus a new cycle starts to obtain a new sheet F and position it in the station SO.

Suitable folding—heat-welding means fold, according to techniques known to those skilled in the art, the sheet F near the stack head and stabilize the folding by heat-welding.

It results evident from what above that the line 1 must be moved in time relation with the positioning of the slide 32 in the station SR; in other words, there is a time interval (the slide to-and-fro stroke), during which no stack P is introduced into the station SR.

Figure 6:
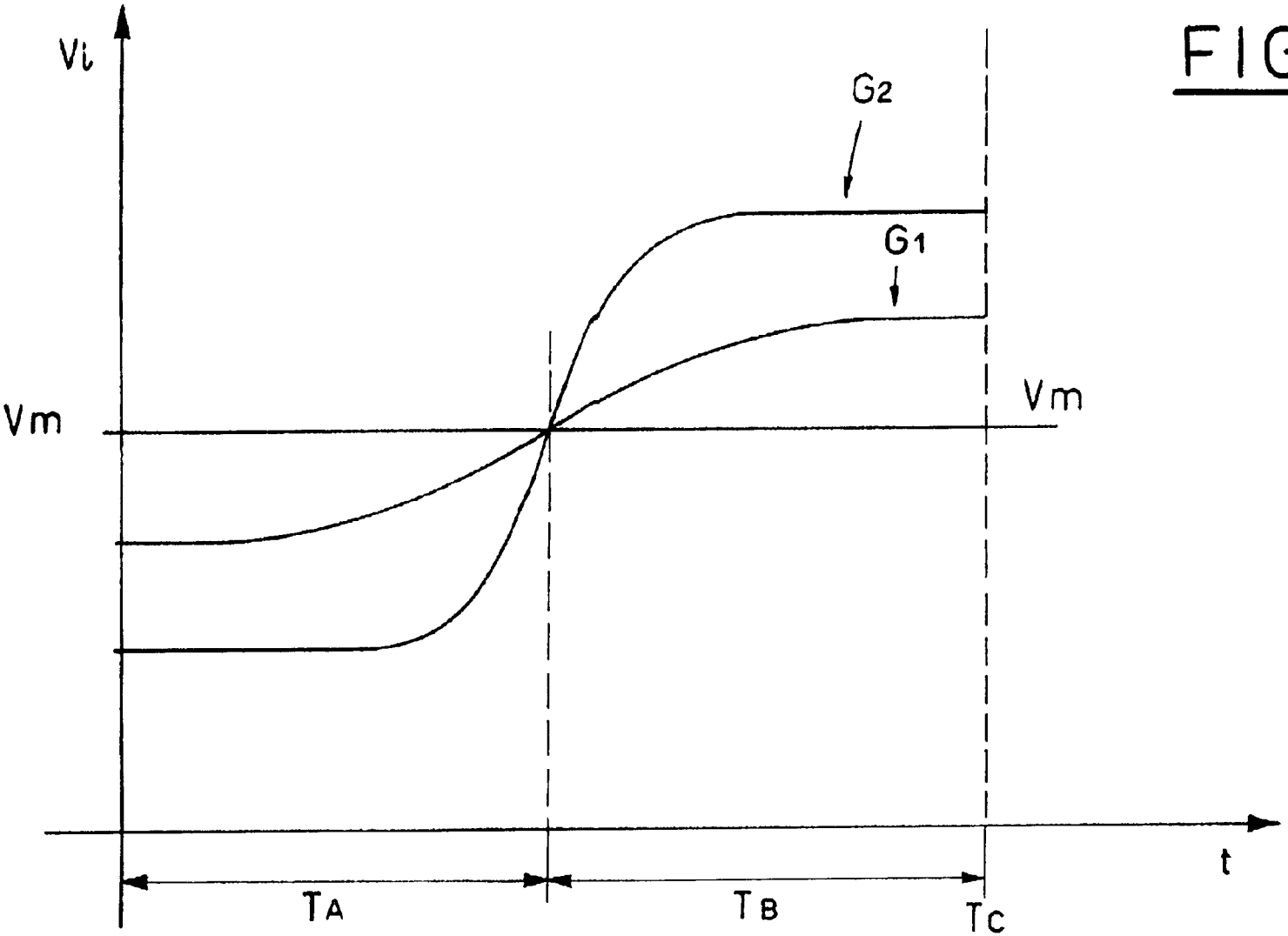
FIG. 6 is a graph showing the speed of the feeding line as a function of time.

This is taken into consideration, when the instant speed $V_i$ of the pulling elements 5 is advantageously reduced with respect to the medium value Vm, in a first time interval TA, which is a fraction of the basic cycle time TC, and increased in the other fraction TB of the cycle TC (see graph G1 of FIG. 6).

During the first interval (slow line), the line 1 is fed with stacks coming from connected channels 80A, 80B, and the slide 32 performs its to-and-fro strokes.

During the second interval TB, when the station SR is fed with one stack P, the increase of the speed of the line 1 (i.e. of the elements 5), allows to restore the predetermined medium value.

This technical-functional aspect allows to adapt the speed to the productivity needs of the machine, in particular to any size change.

For instance, the graph G2 of FIG. 6 relates to the instant speed of a double pack, i.e. two stacks drawn close to each other, in the direction W1; in this case, the slowing down, as well as the subsequent acceleration, is more accentuated with respect to the single pack (i.e. only one stack).

According to an interesting embodiment of the proposed machine, the speed of the first, second and third belts 18, 22, 28 is not zeroed; in other words, the speed VB passes directly to the speed VC (see the broken line GX of FIG. 7): this allows to reduce the stresses to which the sheet F is subjected due to the changes of speed and to reduce, if necessary, the time needed by the second line 2 to detach a sheet F from the film K and, subsequently, to position it in dwelling in the working station SO, so that the sheet waits to be hit by a stack P or by a pack formed by two or more stacks P.

With reference to FIGS. 3*a*, 3*b*, 4*a*, 4*b*, the reference H indicates the operation distance between the pressing means (with the slide 32 in start position) and the shaped profiles 37, 38 of the conveyors 35, 36, while the reference H1 indicates the distance between the outer run of the third belts 28 and the shaped profiles 37, 38.

Figure 8A:
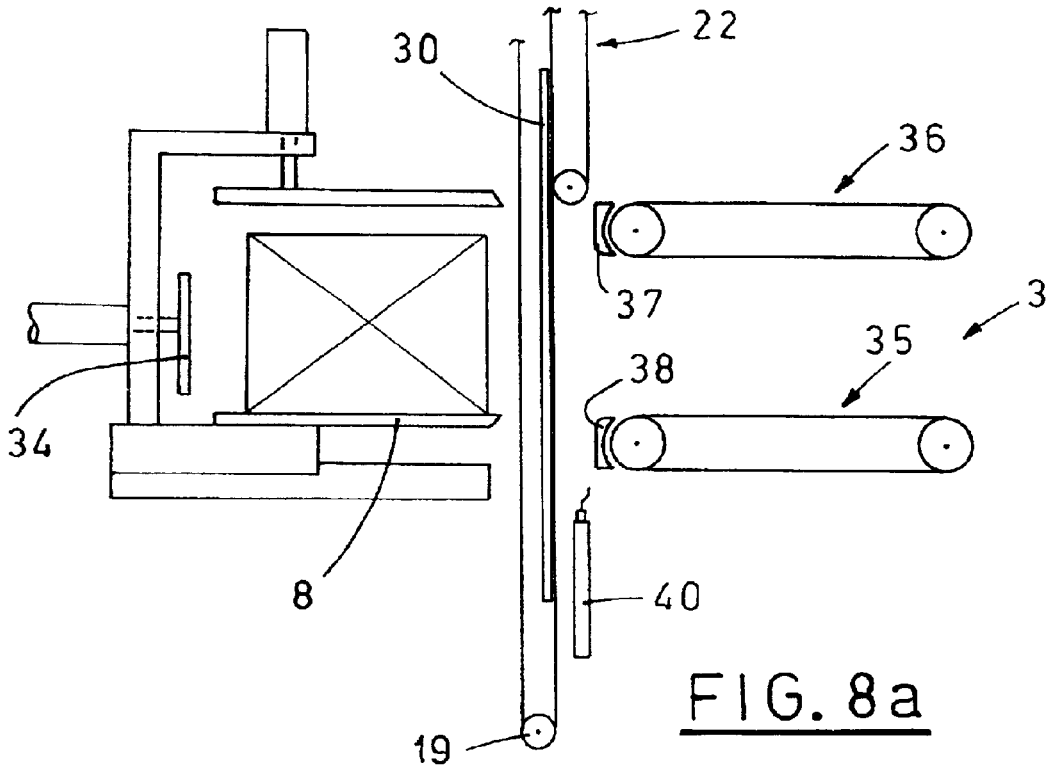
FIGS. 8*a*, 8*b* show a constructive variant of the proposed machine.
Figure 8B:
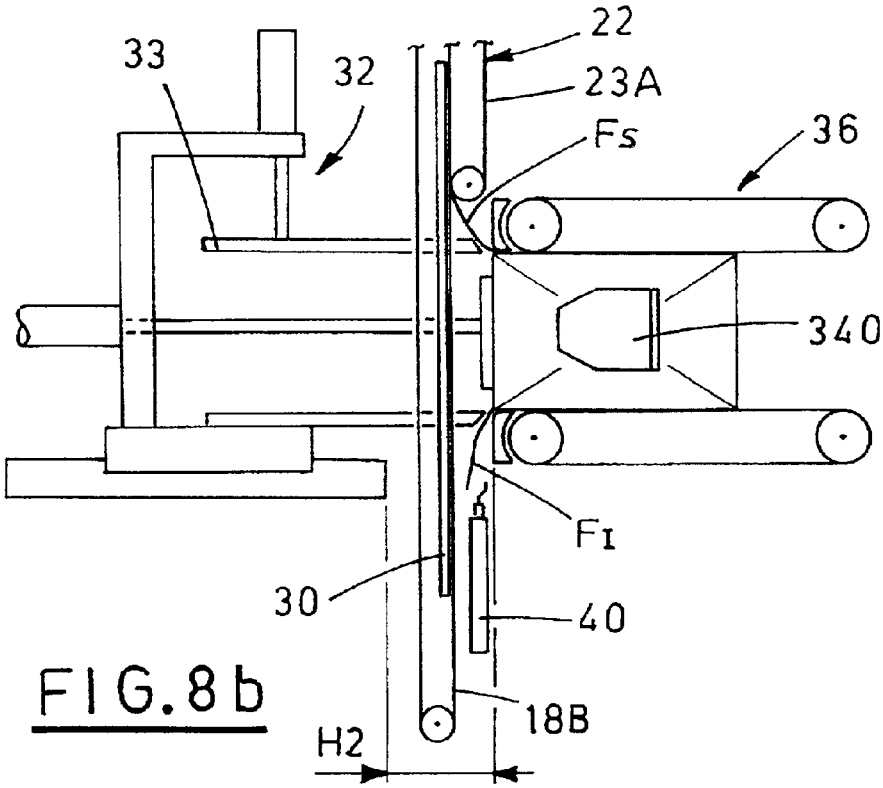

According to the variant shown in FIGS. 8*a*, 8*b*, there are no third strip-like belts 28, because their function is fulfilled by suction means 30, which extend downwards, so as to keep the maximum possible size of the sheet F adherent to the inner run 18*b* of the first belts 18, in cooperation with the upper area Z2.

Consequently, the distance H2 between the shaped profiles 37, 38 and the pressing means (with the slide 32 in the starting position) is reduced with respect to the distance H, mentioned in the first embodiment: this allows to reduce advantageously the entity of the slide 32 stroke.

Such distance H2 can be further reduced by moving the folding means 340 downstream, i.e. with respect to the shaped profiles 37, 38 (FIG. 8*b*).

The folding means 340 are aimed at folding, in known way, the sheet F near the edges turned upstream of the front, opposite heads of the stack P.

Consequently, the line 1 is such that the wrapping sheet F is kept in the working station SO without the help of the previously packaged stacks or suction means; actually, the suction means 30, cooperating with the first belts 18, facilitate the passage of the sheet through the window Y, therefore, the air pressure changes do not affect the machine productive process.

Due to the hitting of the stack P against the sheet F, the upper portion $F_s$ and the lower portion $F_I$ of the sheet are not subjected to curling or stretching; actually, the upper portion $F_s$ is fed, along the direction W2, by the first and second belts 18, 22 at the speed VC equal to the speed of the extrusion of the stack from the opposite surfaces of the base 8 and the pressing plate 33, while the lower portion $F_I$ (the first embodiment) remains tight on the inner runs 28A of the third belts, because it is rubbed against the latter by the combined action of the suction means 31 and the inner runs 28A moving downwards (direction W2*), or (second embodiment), remains tight and rubbed against the inner run 18B of the first belts due to the action of the suction means 30.

The window Y is adjusted in relation to the pile size in a continuous, simple and rapid way, as it is enough to act on the tensioning means 25 to adjust the height of the pair of wheels 23A.

Another advantage of the second line results from the fact that the working group 70 is fed by the slow run 16, whose facing runs are operated with the speed $V_0$, which is constant; consequently, the film K is drawn from the reel 13 with constant traction, which results in the fact that the second line 2, and therefore, the whole machine, operates in the same way with different types of material, (e.g . advantageous polythene) and indifferently from the reel position, which can be placed low, near the base of the machine structure.

Another interesting technical-functional aspect of the machine derives from the fact that the pulling elements 5 of the first line 1 incorporate a security device, which releases these elements when they are subjected to anomalous stresses.

Moreover, the speed of the first line changes in relation to the productive needs of the machine.

What is claimed is:

1. A machine for packaging stacks of multiply articles of paper into wrappings obtained by wrapping sheets, the machine comprising:

a first line for conveying and separating stacks of multiply articles of paper;

a working station for wrapping stacks of multiply articles of paper;

a second line for feeding stepwise heat-weldable wrapping sheets to the working station, each sheet being placed and kept vertically in a waiting position in the working station;

a third line (3) including an upstream section fed stepwise with stacks by the first line, and passing crosswise through the working station, the third line moving at least one stack towards the sheet, so that the sheet gradually folds around the stack or stacks longitudinal contour while overlapping parallel edges of the sheet are heat-welded;

said second line further including:

first means and second means designed for receiving a wrapping sheet from conveying means situated upstream, for pulling said sheet to said working station, for clamping said sheet in said working station in at least one upper area;

keeping means cooperating with said first means to allow said sheet to pass through said working station and to be stabilized while dwelling therein;

said second means cooperating with said first means to clamp said sheet in said working station in at least a lower area and an upper area;

said first means include at least one pair of first endless belts having inner runs cooperating with said keeping means, said first endless belts being mounted around relative wheels and spaced apart to engage, when operated synchronously, corresponding edges of a surface of said sheet, said first belts forming a straight section passing through at least said station;

said second means include at least one pair of second endless belts mounted around wheels and spaced apart to engage, when operated synchronously and with the same speed as said first endless belts, corresponding edges of another surface of said sheet facing said second endless belts, said second endless belts defining a straight section situated in the upper part of said working station.

2. A machine, according to claim 1, further including at least one pair of wheels around which said second endless belts are mounted, said one pair of wheels being situated in said working station and adjustable vertically to adjust the height of a window through which said stack passes.

3. A machine, according to claim 1, wherein:

said second means include an upper section and a lower section respectively, with the upper section being comprised of at least one pair of second endless belts mounted around wheels, said second endless belts being spaced apart to engage, when operated synchronously and with a same speed as said first endless belts, corresponding edges of another surface of said sheet facing said second endless belts, said second endless belts defining a straight section situated in the upper part of said working station, said lower section including at least one pair of third endless belts, mounted around wheels and operated synchronously and with the same speed as said first endless belts to engage the same edges of the sheet surface which are engaged by said second endless belts, said third endless belts facing the lower part of said straight section of the first endless belts and being spaced apart from said second endless belts to define a window, through which said stack passes.

4. A machine, according to claim 1, further including at least one pair of wheels around which said second endless belts are mounted, said one pair of wheels being situated in said working station and adjustable vertically to adjust the height of the window through which said stack passes.

5. A machine, according to claim 1, wherein said keeping means extend downwards, so as to keep the maximum possible size of the sheet adherent to the an inner run of the first endless belts.

6. A machine, according to claim 1, wherein said keeping means includes suction means.

7. A machine, according to claim 4, further including folding means situated downstream of said shaped profiles and designed to fold the sheet along flaps turned upstream of the stack.

8. A machine, according to claim 1, wherein said first line includes right angle pulling elements having bases and wing elements, said bases hinged to an outer ring extending vertically, said bases being also connected to an inner ring extending vertically, and with said wing elements always kept in vertical position, whereas each base is removably connected to said inner ring such that said base is disengagable from the inner ring if stresses acting on said wing overcome a predetermined value.

9. A machine, according to claim 8, wherein said pulling elements of said first line are operated at a speed variable with respect to a predetermined medium value, and the speed is reduced with respect to said medium value when a stack of articles is introduced into the first line.

10. A machine for packaging stacks of multiply articles of paper into wrappings obtained by wrapping sheets, the machine comprising:

a first line for conveying and separating stacks of multiply articles of paper;

a working station for wrapping stacks of multiply articles of paper;

a second line for feeding stepwise heat-weldable wrapping sheets to the working station, each sheet being placed and kept vertically in a waiting position in the working station;

a third line (3) including an upstream section fed stepwise with stacks by the first line, and passing crosswise through the working station, the third line moving at least one stack towards the sheet, so that the sheet gradually folds around the stack or stacks longitudinal contour while overlapping parallel edges of the sheet are heat-welded;

said second line further including:

first means and second means designed for receiving a wrapping sheet from conveying means situated upstream, for pulling said sheet to said working station, for clamping said sheet in said working station in at least one upper area;

keeping means cooperating with said first means to allow said sheet to pass through said working station and to be stabilized while dwelling therein;

said first means including at least one pair of first endless belts having inner runs cooperating with said keeping means, said first endless belts being mounted around relative wheels and spaced apart to engage, when operated synchronously, corresponding edges of a surface of said sheet, said first belts forming a straight section passing through at least said station;

said second means include an upper section and a lower section respectively, the upper section being comprised of at least one pair of second endless belts mounted around wheels, said second endless belts being spaced apart to engage, when operated synchronously and with a same speed as said first endless belts, corresponding edges of another surface of said sheet facing said second endless belts, said second endless belts defining a straight section situated in the upper part of said working station, said lower section including at least one pair of third endless belts, mounted around wheels and operated synchronously and with the same speed as said first endless belts to engage the same edges of the sheet surface which are engaged by said second endless belts, said third endless belts facing the lower part of said straight section of the first endless belts and being spaced apart from said second endless belts to define a window, through which said stack passes;

the pair of said third endless belts being operated, in time relation with hitting of the stack against the sheet in waiting position in said working station, to move from a working position to a displaced position displaced with respect to the first endless belts, to allow the lower portion of the sheet, introduced between said first endless belts and said third endless belts, to be released.

11. A machine, according to claim 10, wherein said third pair of endless belts are mounted with a capability to swing so as to move close to, or away from the pair of first endless belts.

12. A machine, according to claim 10, wherein said inner runs of the third endless belts are connected with vacuum means, operated in time relation with a movement away from the first endless belts, to rub, in combination a downward movement of the inner runs, the lower portion of a sheet introduced between said first endless belts and said third endless belts, against the inner runs.

13. A machine, according to claim 10, wherein the inner runs of said third endless belts move downwards in time relation with a movement of said third endless belts far away the first endless belts.

14. A machine for packaging stacks of multiply articles of paper into wrappings obtained by wrapping sheets, the machine comprising:

a first line for conveying and separating stacks of multiply articles of paper;

a working station for wrapping stacks of multiply articles of paper;

a second line for feeding stepwise heat-weldable wrapping sheets to the working station, each sheet being placed and kept vertically in a waiting position in the working station;

a third line (3) including an upstream section fed stepwise with stacks by the first line, and passing crosswise through the working station, the third line moving at least one stack towards the sheet, so that the sheet gradually folds around the stack or stacks longitudinal contour while overlapping parallel edges of the sheet are heat-welded;

said second line further including;

first means and second means designed for, receiving a wrapping sheet from conveying means situated upstream, for pulling said sheet to said working station, for clamping said sheet in said working station in at least one upper area;

keeping means cooperating with said first means to allow said sheet to pass through said working station and to be stabilized while dwelling therein;

pressing means situated upstream of the working station for receiving and pressing at least one stack of articles to be packaged;

pusher means for transferring longitudinally said stack, so that said stack hits a wrapping sheet previously positioned vertically in said working station;

conveying means situated downstream of said working station, with a stack partially wrapped within the wrapping sheet being introduced into said conveying means;

said pressing means for receiving and pressing said stack to be packaged and said pusher means for longitudinal transfer of the stack, being carried by a slide moving longitudinally between a backward position with respect to the positioning plane of the wrapping sheet, in which said stack is received and pressed, and a forward position, in which said compressing means for receiving and compressing the stack, hit and stretch said wrapping sheet, so as to move close to said conveying means to transfer said stack to said conveying means.

15. A machine according to claim 14, wherein said pressing means for receiving and pressing said stack, include a base plate fastened to said slide, said stack being fed onto said base plate, and a cover pressing plate for moving vertically.

16. A machine, according to claim 15, wherein said base plate and said pressing plate have a fore edge turned toward said wrapping sheet and formed with tapered corners.

17. A machine, according to claim 14, wherein said conveying means face, on a side turned toward said wrapping sheet, a pair of shaped profiles for facilitating introduction of a stack between opposite runs of said conveying means.

18. A machine, according to claim 17, further including folding-welding means for folding and welding overlapped edges of said wrapping sheet partially wrapping a stack introduced between opposite runs of said conveying means, with said folding-welding means acting substantially at a position flush with said shaped profiles.

19. A machine for packaging stacks of multiply articles of paper into wrappings obtained by wrapping sheets, the machine comprising:

a first line for conveying and separating stacks of multiply articles of paper;

a working station for wrapping stacks of multiply articles of paper;

a second line for feeding stepwise heat-weldable wrapping sheets to the working station, each sheet being placed and kept vertically in a waiting position in the working station;

a third line (3) including an upstream section fed stepwise with stacks by the first line, and passing crosswise through the working station, the third line moving at least one stack towards the sheet, so that the sheet gradually folds around the stack or stacks longitudinal contour while overlapping parallel edges of the sheet are heat-welded;

said second line further including;

first means and second means designed for receiving a wrapping sheet from conveying means situated upstream, for pulling said sheet to said working station, for clamping said sheet in said working station in at least one upper area;

keeping means cooperating with said first means to allow said sheet to pass through said working station and to be stabilized while dwelling therein;

said first means and second means follow in cascade a slow run defined by two facing runs operated with constant speed, a sheet of film drawn from a reel and acted on by a cutting group being inserted between said two facing runs, said cutting group operating stepwise to make crosswise cutting lines defining pre-breaking sections;

said first and second means being operated with different speeds, so that a leading edge of the film can be introduced between said first and second means to break the pre-breaking section of the film situated in the slow run, in order to detach a sheet, obtained by the breaking, from the leading edge of the film, which is situated between the facing runs of the slow run, so as to locate said sheet in the working station, to feed the lower portion of said sheet to said working station, due to hitting of a stack against the sheet.

* * * * *